US005584338A

United States Patent [19]

Freeman et al.

[11] Patent Number: 5,584,338

[45] Date of Patent: Dec. 17, 1996

[54] METAL STRIP CASTING

[75] Inventors: John Freeman, Kahibah; Lazar Strezov, Adamstown; Steve Osborn, Whitebridge, all of Australia

[73] Assignees: Ishikawajima-Hara Heavy Industries Company Limited, Tokyo, Japan; BHP Steel (JLA) Pty. Ltd., Melbourne, Australia

[21] Appl. No.: 442,655

[22] Filed: May 16, 1995

[30] Foreign Application Priority Data

May 27, 1994 [AU] Australia ..... PM5898

[51] Int. Cl.[6] ..... B22D 11/06; B22D 11/00; B22D 27/08

[52] U.S. Cl. ..... 164/478; 164/416; 164/428; 164/480

[58] Field of Search ..... 164/478, 416, 164/71.1, 260, 480, 428

[56] References Cited

FOREIGN PATENT DOCUMENTS

| | | | |
|---|---|---|---|
| 58-41658 | 3/1983 | Japan | 164/478 |
| 60-223647 | 11/1985 | Japan | 164/478 |
| 1148698 | 4/1985 | U.S.S.R. | 164/416 |

*Primary Examiner*—Kuang Y. Lin
*Attorney, Agent, or Firm*—Nikaido Marmelstein Murray & Oram LLP

[57] ABSTRACT

A method and an apparatus of continuously casting metal strip (20) is disclosed. A casting pool (30) of molten metal is formed in contact with a moving casting surface such that metal solidifies from the pool (30) onto the moving casting surface. In addition, sound waves are applied to the casting pool of molten metal to induce relative vibratory movement between the molten metal of the casting pool (30) and the casting surface.

17 Claims, 10 Drawing Sheets

23
17
18
14
15
9
46
10
10
19
24
8
18
8
16
56
9

METAL STRIP CASTING

TECHNICAL FIELD

This invention relates to the casting of metal strip. It has particular but not exclusive application to the casting of ferrous metal strip.

It is known to cast metal strip by continuous casting in a twin roll caster. Molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

Although twin roll casting has been applied with some success to non-ferrous metals which solidify rapidly on cooling, there have been problems in applying the technique to the casting of ferrous metals. One particular problem has been the achievement of sufficiently rapid and even cooling of metal over the casting surfaces of the rolls.

Our International Patent Application PCT/AU93/00593 describes a development by which the cooling of metal at the casting surface of the rolls can be dramatically improved by taking steps to ensure that the roll surfaces have certain smoothness characteristics in conjunction with the application of relative vibratory movement between the molten metal of the casting pool and the casting surfaces of the rolls. Specifically that application discloses that the application of vibratory movements of selected frequency and amplitude make it possible to achieve a totally new effect in the metal solidification process which dramatically improves the heat transfer from the solidifying molten metal, the improvement being such that the thickness of the metal being cast at a particular casting speed can be very significantly increased or alternatively the speed of casting can be substantially increased for a particular strip thickness. The improved heat transfer is associated with a very significant refinement of the surface structure of the cast metal.

We have now determined that it is possible to induce effective relative vibration between the molten metal of the casting pool and the casting surface so as to achieve the above benefits by the application of sound waves to the molten metal of the casting pool. Beneficial results in terms of increased heat transfer and solidification structure refinement can be achieved by the application of sound waves in the sonic range at quite low power levels.

In the ensuing description it will be necessary to refer to a quantitative measure of the smoothness of casting surfaces. One specific measure used in our experimental work and helpful in defining the scope of the present invention is the standard measure known as the Arithmetic Mean Roughness Value which is generally indicated by the symbol $R_a$. This value is defined as the arithmetical average value of all absolute distances of the roughness profile from the centre line of the profile within the measuring length $l_m$. The centre line of the profile is the line about which roughness is measured and is a line parallel to the general direction of the profile within the limits of the roughness-width cut-off such that sums of the areas contained between it and those parts of the profile which lie on either side of it are equal. The Arithmetic Mean Roughness Value may be defined as $$R_a = \frac{1}{l_m} \int_{x=0}^{x=l_m} |y| dx$$

DISCLOSURE OF THE INVENTION

According to the invention there is provided a method of continuously casting metal strip of the kind in which a casting pool of molten metal is formed in contact with a moving casting surface such that metal solidifies from the pool onto the moving casting surface, wherein sound waves are applied to the casting pool of molten metal to induce relative vibratory movement between the molten metal of the casting pool and the casting surface.

More specifically the invention provides a method of continuously casting metal strip of the kind in which molten metal is introduced into the nip between a pair of casting rolls via a metal delivery nozzle disposed above the nip to create a casting pool of molten metal supported on casting surfaces of the rolls immediately above the nip and the casting rolls are rotated to deliver a solidified metal strip downwardly from the nip, wherein sound waves are applied to the casting pool of molten metal to induce relative vibratory movement between the molten metal of the casting pool and the casting surfaces of the rolls.

The invention further provides apparatus for continuously casting metal strip comprising a pair of casting rolls forming a nip between them, a metal delivery nozzle for delivery of molten metal into the nip between the casting rolls to form a casting pool of molten metal supported on casting roll surfaces immediately above the nip, roll drive means to drive the casting rolls in counter-rotational directions to produce a solidified strip of metal delivered downwardly from the nip, and sound application means to apply sound waves to the casting pool of molten metal whereby to induce relative vibratory movement between the molten metal of the casting pool and the casting surfaces of the rolls.

Preferably the sound waves are applied to a free upper surface of the molten metal casting pool.

The sound waves may be transmitted from a sound generator through an acoustic coupling channel to the free surface of the casting pool.

The sound generator may be an acoustic loud speaker and the coupling channel may be provided by a hollow tube or duct extending from the loud speaker to the free surface of the casting pool. The tube or duct may be shaped as a horn to diverge toward the surface of the pool.

Sound waves may be applied to separate regions of the casting pool surface in which case there may be a plurality of sound wave generators with separate acoustic coupling devices extending from those generators to respective regions of the casting pool surface. Specifically there may be a pair of sound wave generators and a respective pair of acoustic coupling devices extending from those generators to regions of the casting pool surface disposed to either side of the metal delivery nozzle.

Preferably the sound waves comprise waves in the sonic frequency range. They may for example comprise waves in the frequency range 50 to 1000 Hz.

Preferably, the sound waves are applied over a spread of frequencies within the range. They may, for example, be applied as a wide band noise signal covering the frequencies 200 to 300 Hz.

The sound waves may be transmitted at an acoustic intensity in the range of 125 to 150 dB.

Preferably the casting surface or surfaces have an Arithmetical Mean Roughness Value ($R_a$) of less than 5 microns.

By the present invention it is possible to achieve the same refinement of the surface grain structure in the resulting metal strip as is disclosed in our earlier International Application PCT/AU93/00593. Accordingly it is possible to produce metal strip with a nucleation density of at least 400 nuclei/mm$^2$.

In a typical process according to the invention for producing steel strip the nucleation density may be in the range 600 to 700 nuclei/mm$^2$.

BRIEF DESCRIPTION OF THE DRAWINGS

In order that the invention may be more fully explained the results of experimental work carried out to date will be described with reference to the accompanying drawings in which.

DETAILED DESCRIPTION OF THE PREFERRED EMBODIMENT

Figure 1:
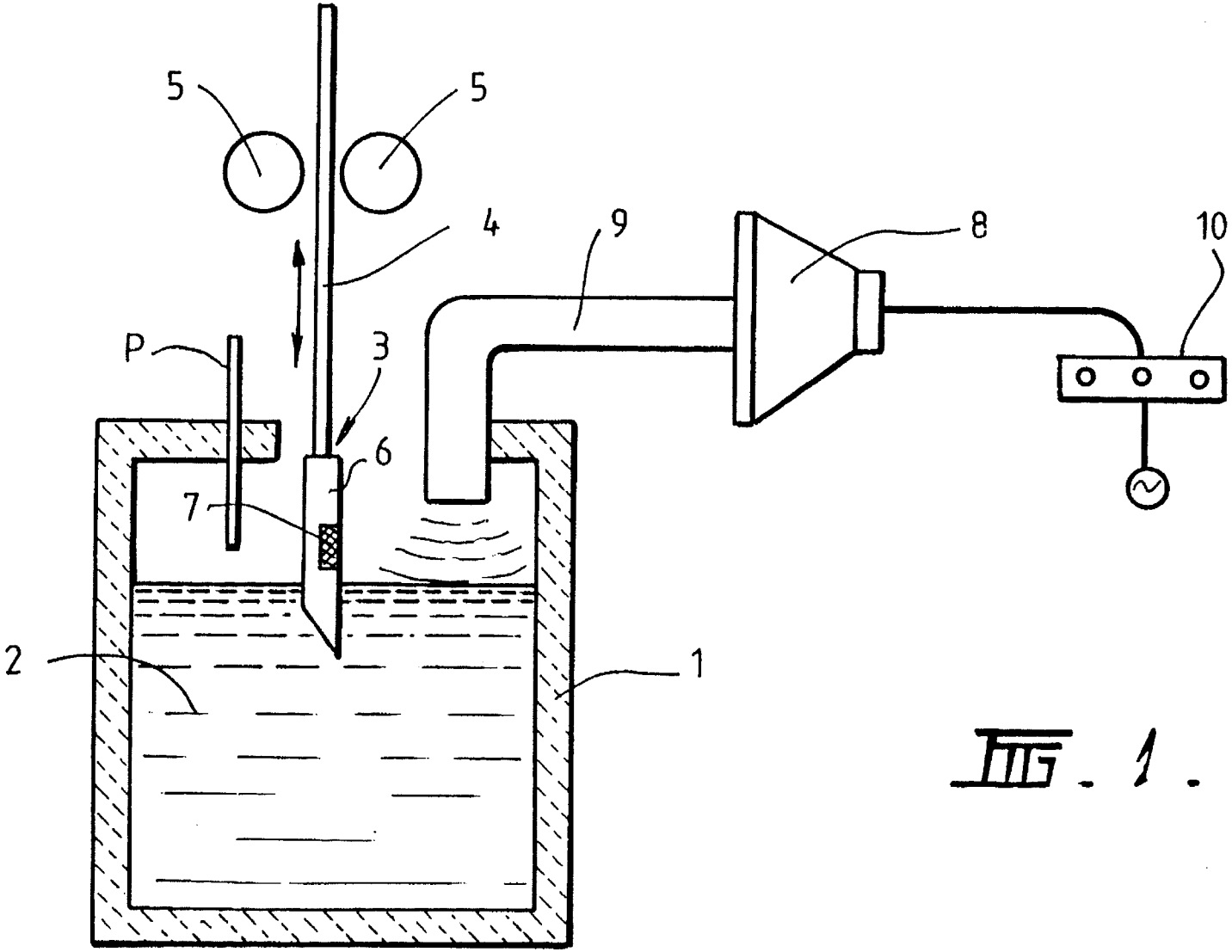
FIG. 1 illustrates experimental apparatus for determining metal solidification rates under conditions simulating those of a twin roll caster with the application of sound waves to a casting pool surface.

FIG. 1 illustrates a metal solidification test rig in which a 40 mm×40 mm chilled block is advanced into a bath of molten steel and at such a speed as to closely simulate the conditions at the melt/roll interface of a twin roll caster. Steel solidifies onto the chilled block as it moves through the molten bath to produce a layer of solidified steel on the surface of the block. The thickness of this layer can be measured at points throughout its area to map variations in the solidification rate and therefore the effective rate of heat transfer at the various locations. It is thus possible to determine an overall solidification rate as well as to map individual solidification rates throughout the solidified strip. Solidification rates are generally measured by a factor K determined in accordance with the formula $d=\sqrt{kvt}$, where d is the strip thickness and t is time. It is also possible to examine the microstructure of the strip surface to correlate changes in the solidification microstructure with the changes in the observed heat transfer values.

The experimental rig illustrated in FIG. 1 comprises an inductor furnace 1 containing a melt of molten metal 2 in an inert atmosphere of Argon gas. An immersion paddle denoted generally as 3 is mounted on a slider 4 which can be advanced into the melt 2 at a chosen speed and subsequently retracted by the operation of computer controlled motors 5.

Immersion paddle 3 comprises a steel body 6 which contains a copper substrate 7 in the form a 40×40 mm square×18 mm thick copper block. It is instrumented with thermal couples to monitor the temperature rise in the substrate.

The experimental rig further comprises a sound wave generator 8 and an acoustic coupling device 9 through which to transmit sound waves from generator 8 to the free upper surface of the metal of molten metal 2. Sound wave generator 8 is a standard acoustic loud speaker capable of producing sound waves from an electrical input delivered by an electrical signal generator and amplifier 10. In the test rig the acoustic coupling device 9 is of simple tubular formation and terminates a short distance above the surface of the molten metal within the furnace. The transmission of sound waves to the surface of the casting pool is detected by a pressure sensor P extending into the furnace to a location adjacent the pool surface.

Tests carried out on the experimental rig illustrated in FIG. 1 have demonstrated that the application of sound waves to the molten metal during metal solidification can produce a refined grain structure in the solidifying metal with greatly enhanced heat transfer in much the same manner as the application of mechanical vibrations to the moving substrate as previously disclosed in our International Patent Application PCT/AU93/00593. As with the case of the application of mechanical vibration to the substrate the effect is particularly pronounced if the surface roughness of the chilled casting surface is reduced to low $R_a$ values.

Figure 2:
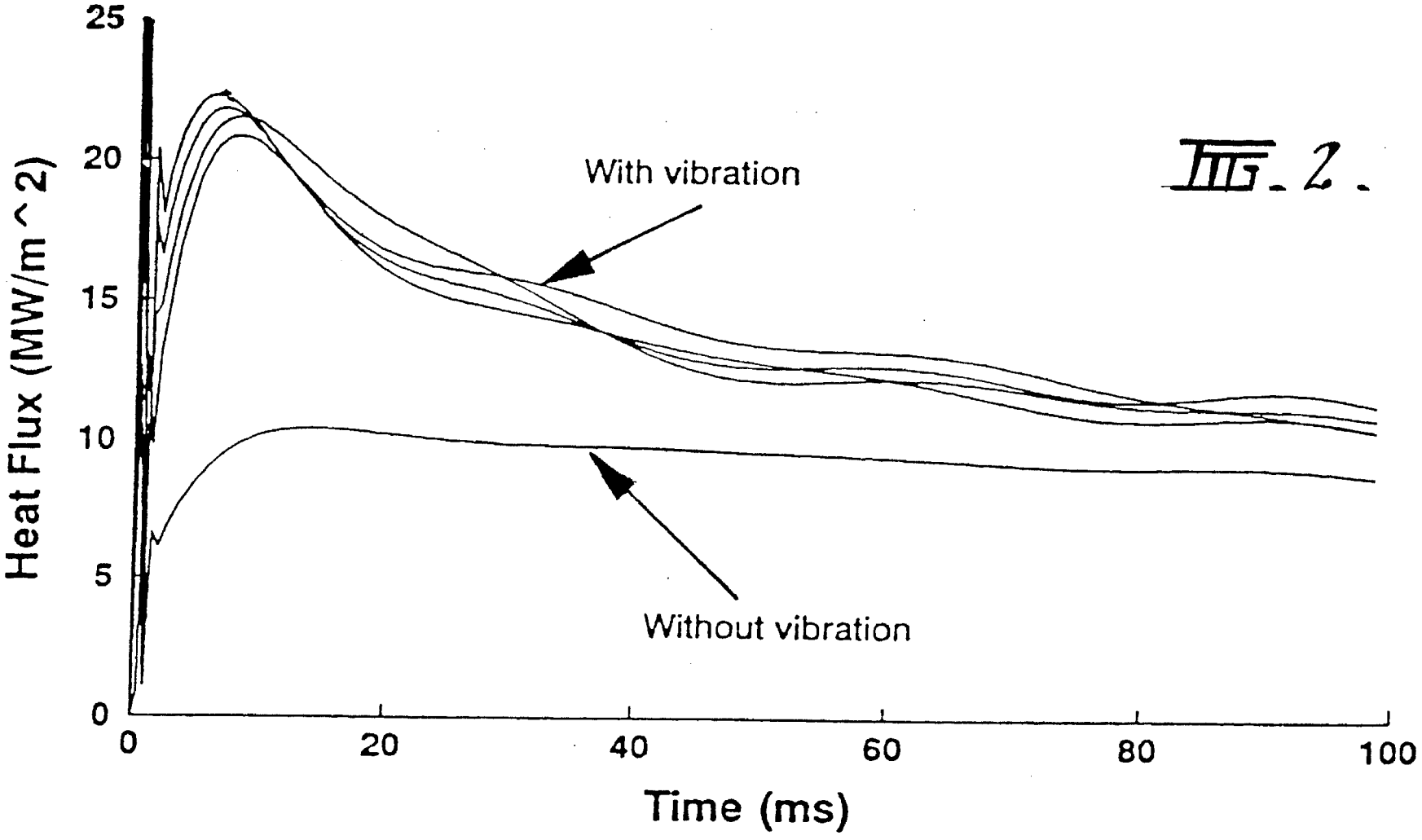
FIG. 2 illustrates heat flux values obtained experimentally with and without the application of sound waves to the casting pool surface.

FIG. 2 illustrates measured heat flux values obtained on solidification of carbon steel onto smooth copper substrates both with and without the application of sound waves to the casting pool surface. In these tests the melt was a carbon steel of the following composition:

| | |
|---|---|
| Carbon | 0.06% by weight |
| Manganese | 0.5% by weight |
| Silicon | 0.25% by weight |
| Aluminium | 0.002% by weight |

It will be seen that the application of sound wave vibration to the casting pool surface produced a very significant increase in the heat flux values, particularly in the early stages of solidification. Accordingly, the solidification rates can be significantly increased, allowing the production of thicker strip or much faster production rates with a strip caster.

In the above tests the sound waves were applied in a spread of frequencies over a range of 100 to 300 Hz and a power of the order of 1 W/cm$^2$ of pool surface area. In order to minimize power requirements it is desirable to apply waves at a resonant frequency. Since the precise resonant frequency may be difficult to determine and may in any event vary with changes in the casting pool level it is preferred to transmit a wide band signal and allow the system to resonate at the appropriate frequency.

Figure 3:
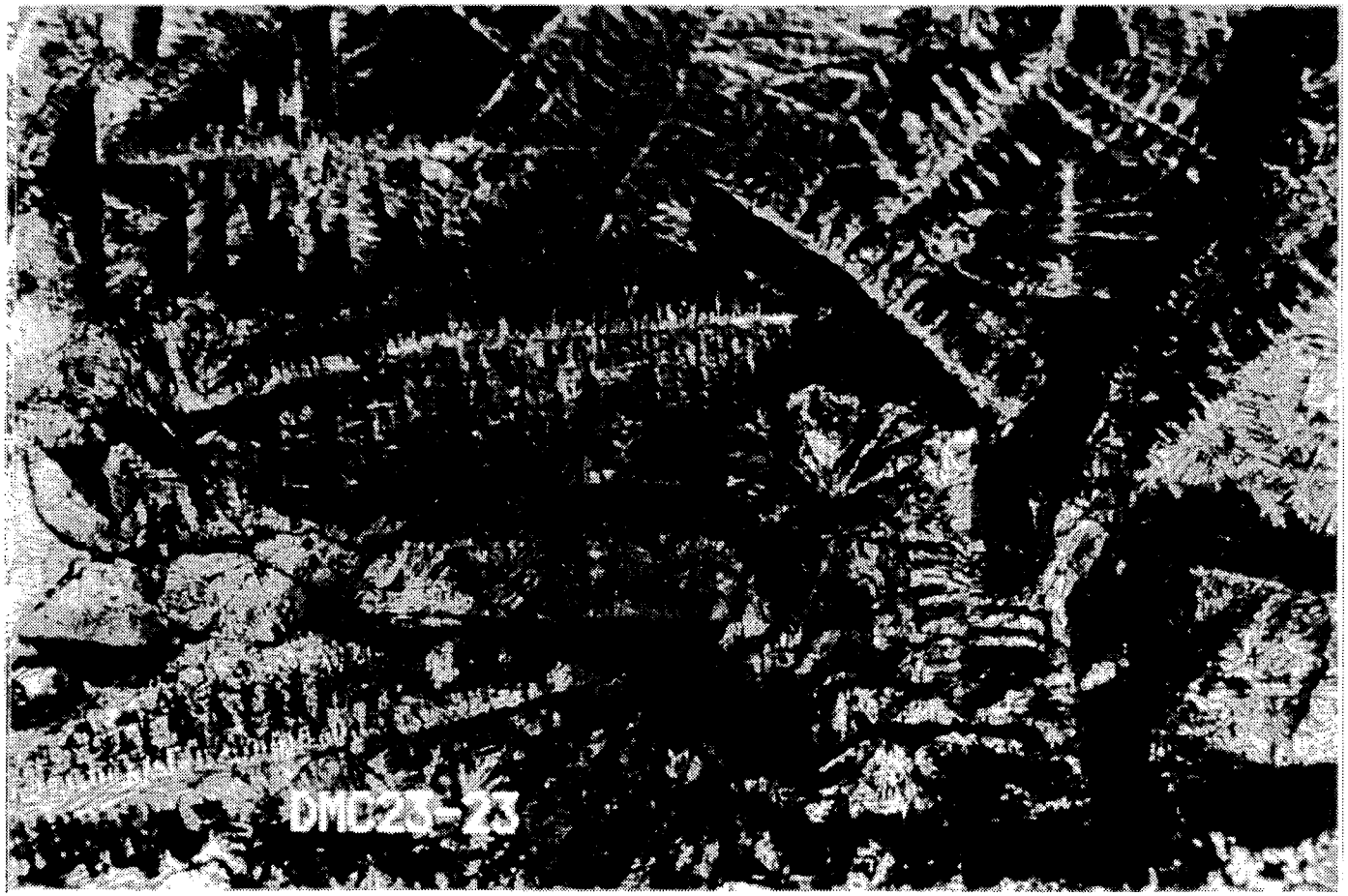
FIGS. 3 and 4 are photo-micrographs showing coarse and refined surface structures of solidified surface metal obtained in the metal solidification experiments from which the data in FIG. 2 was derived.
Figure 4:
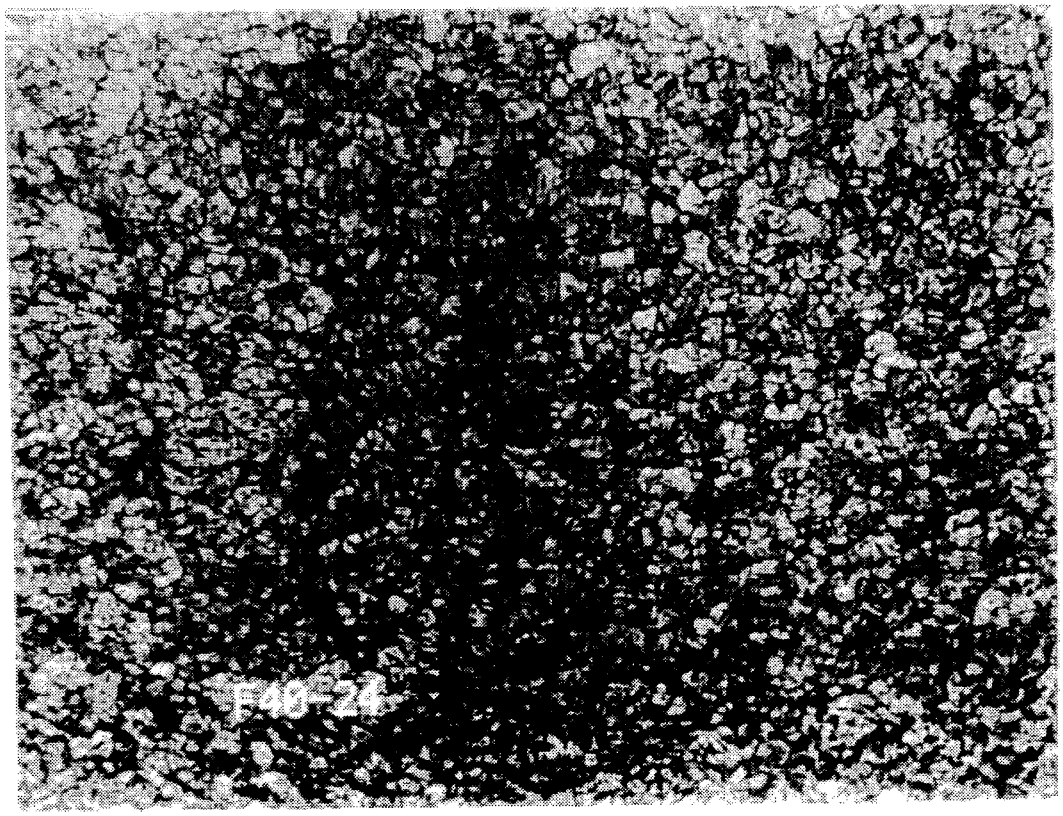

The increased heat flux values obtained by the application of sound wave vibration to the melt was also associated with a marked refinement of the grain structure in the solidified steel. FIG. 3 is a photomicrograph illustrating the surface structure of a steel sample produced without the application of sound wave vibration and FIG. 4 is a photomicrograph showing the surface structure of a typical sample produced with the application of sound waves. It will be seen that without the application of sound waves, the solidified steel has coarse surface Grains with a pronounced dendritic structure. The application of sound wave vibration to the melt surface produces a dramatic refinement of the surface structure in which the grains are very much smaller in size and have a more compact structure. More specifically, the surface structure exhibits a nucleation density in excess of 400 nuclei/$mm^2$ and typically of the order of 600 to 700 nuclei/$mm^2$.

Figure 5:
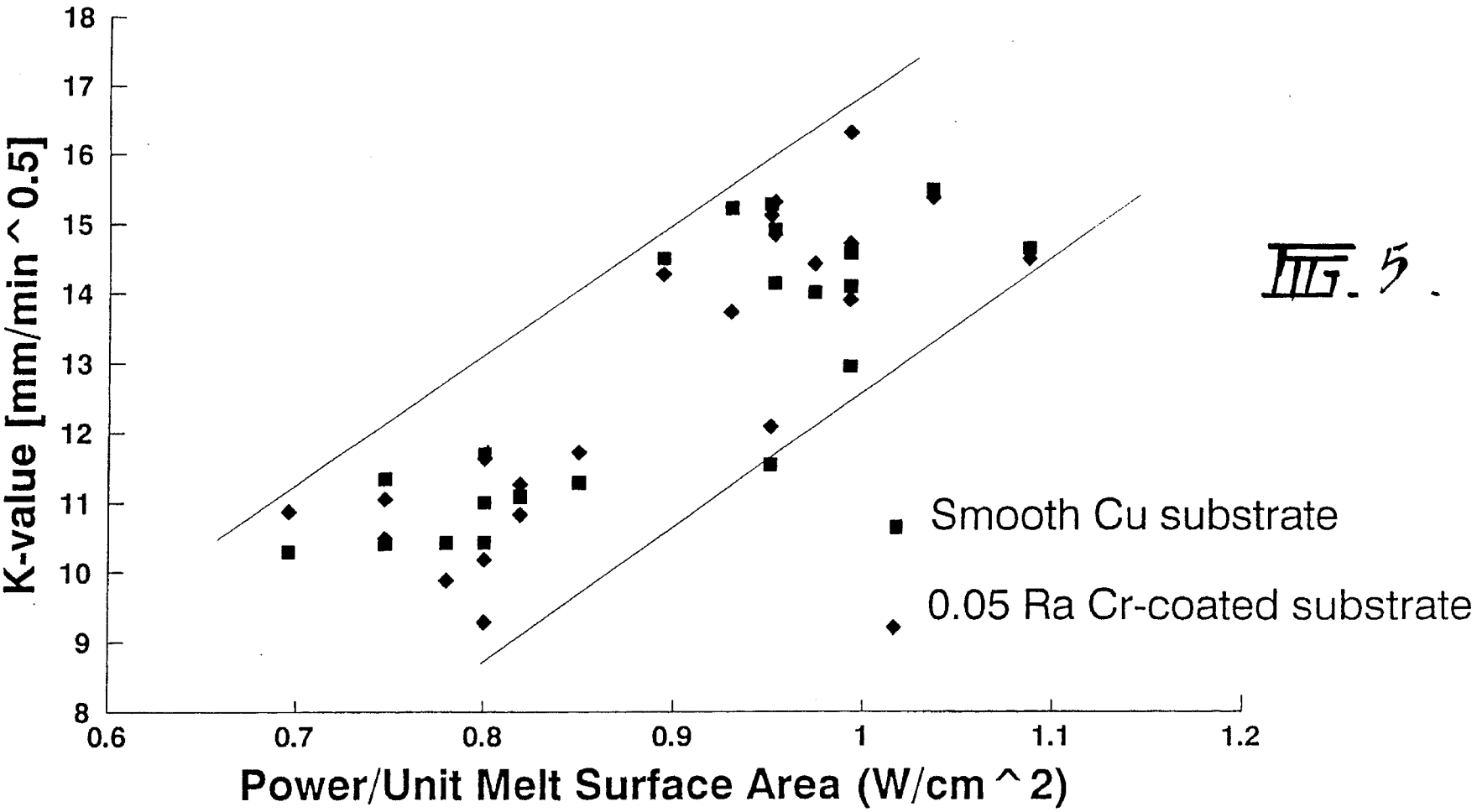
FIG. 5 illustrates solidification constants obtained with the application of sound waves at varying. acoustic power and with substrates of differing roughness.
Figure 6:
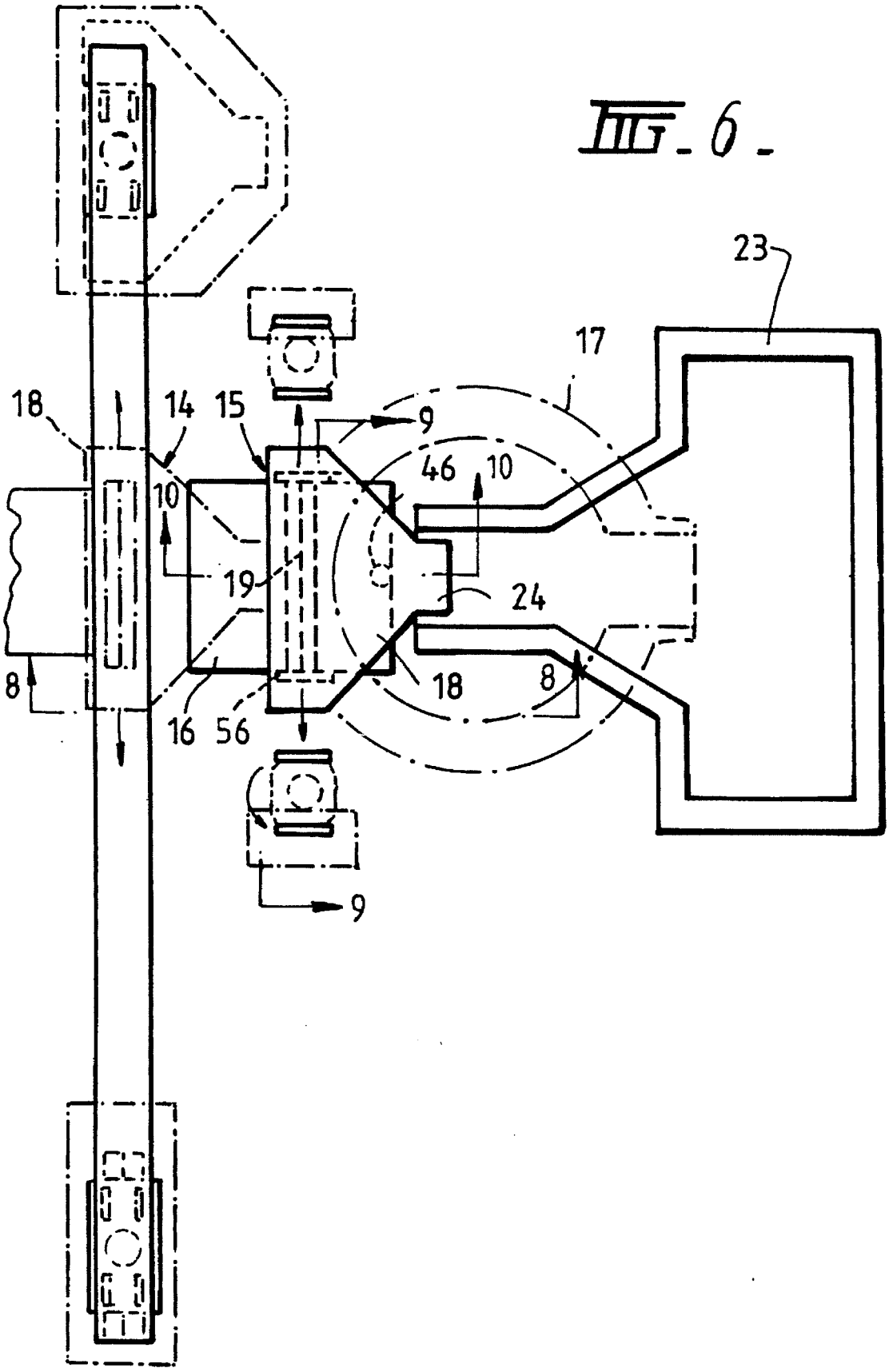
FIG. 6 is a plan view of a continuous strip caster which is operable in accordance with the invention.
Figure 7:
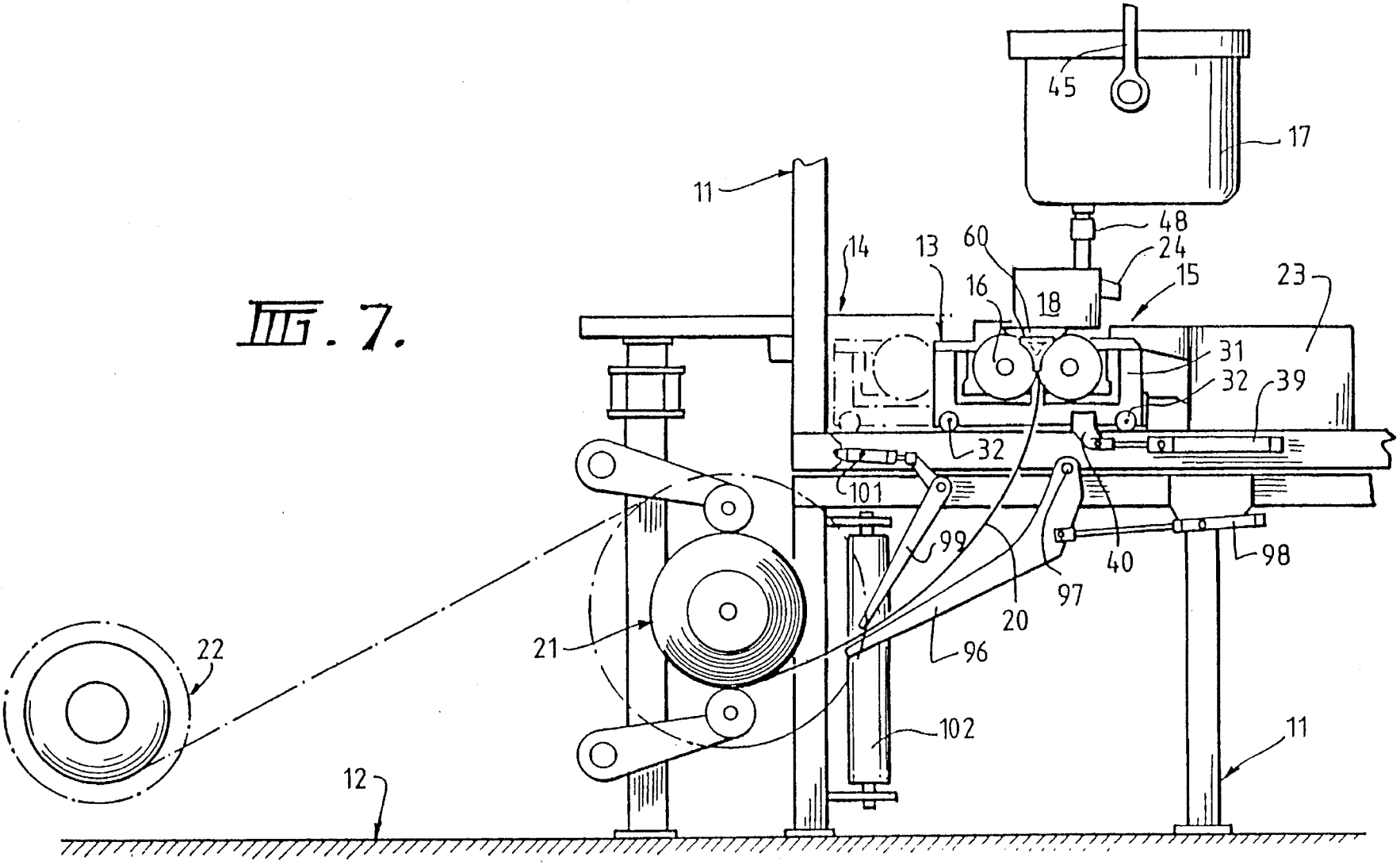
FIG. 7 is a side elevation of the strip caster shown in FIG. 6.
Figure 8:
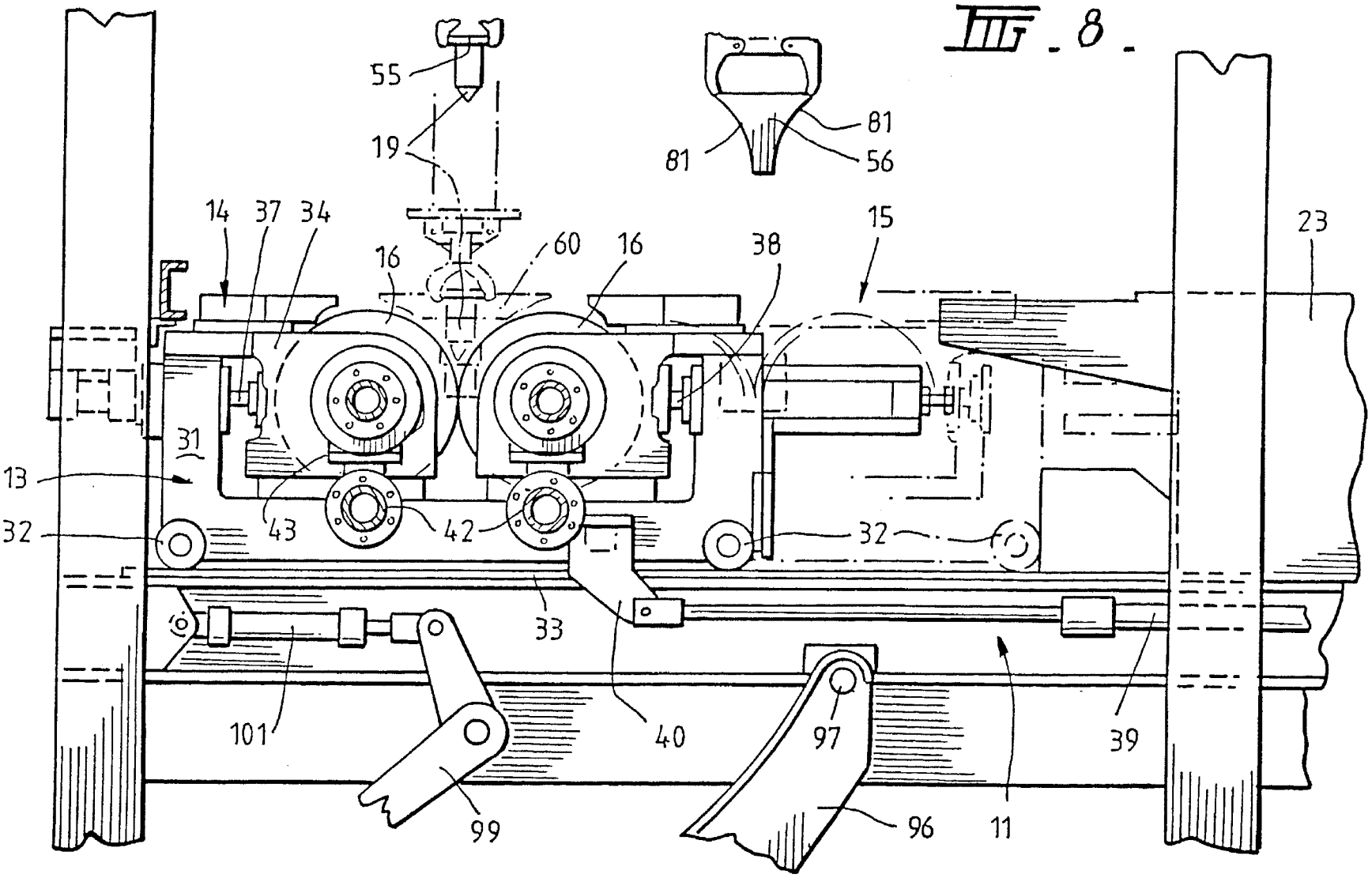
FIG. 8 is a vertical cross-section on the line 8—8 in FIG. 6.
Figure 9:
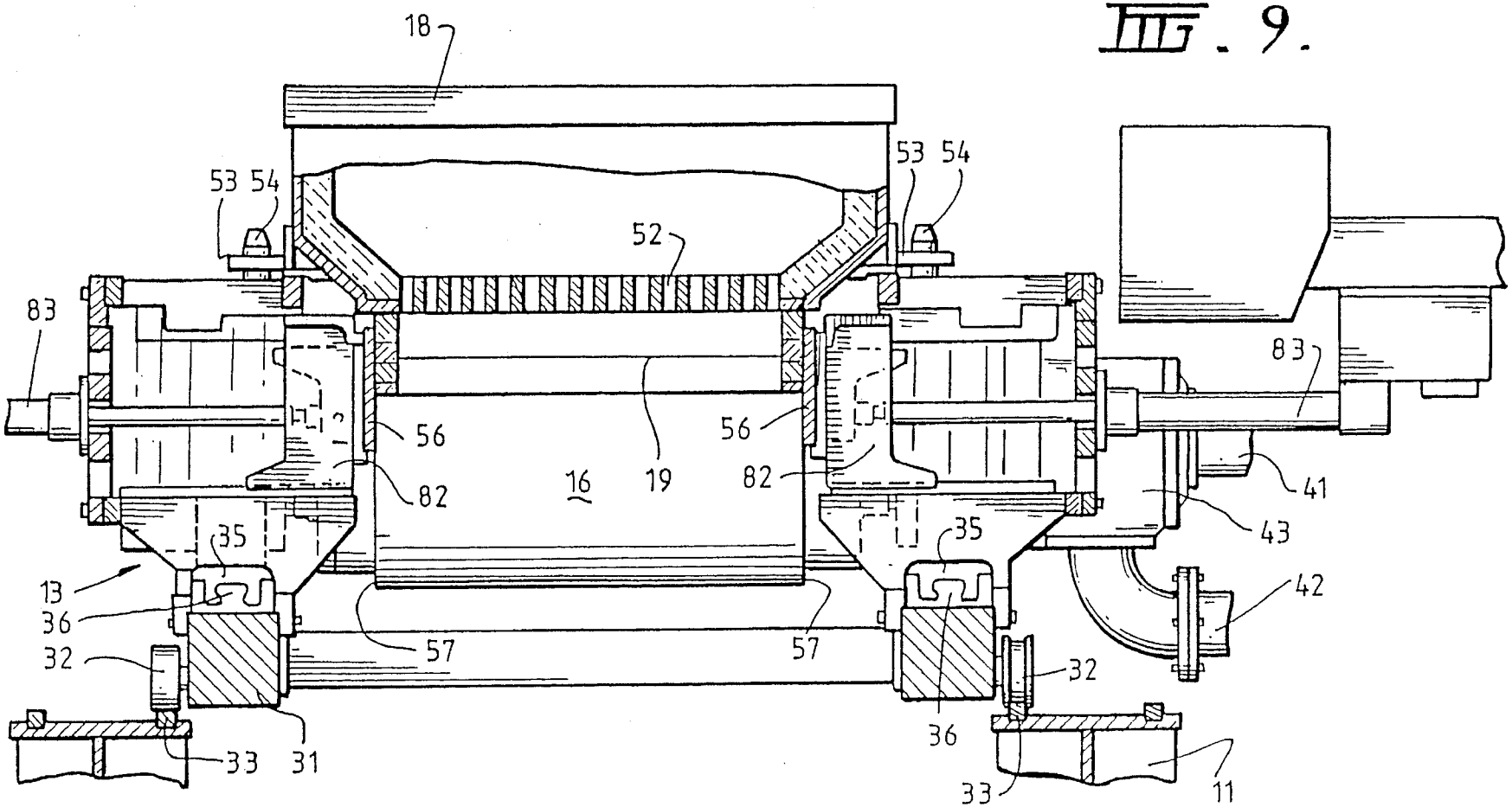
FIG. 9 is a vertical cross-section on the line 9—9 in FIG. 6.
Figure 10:
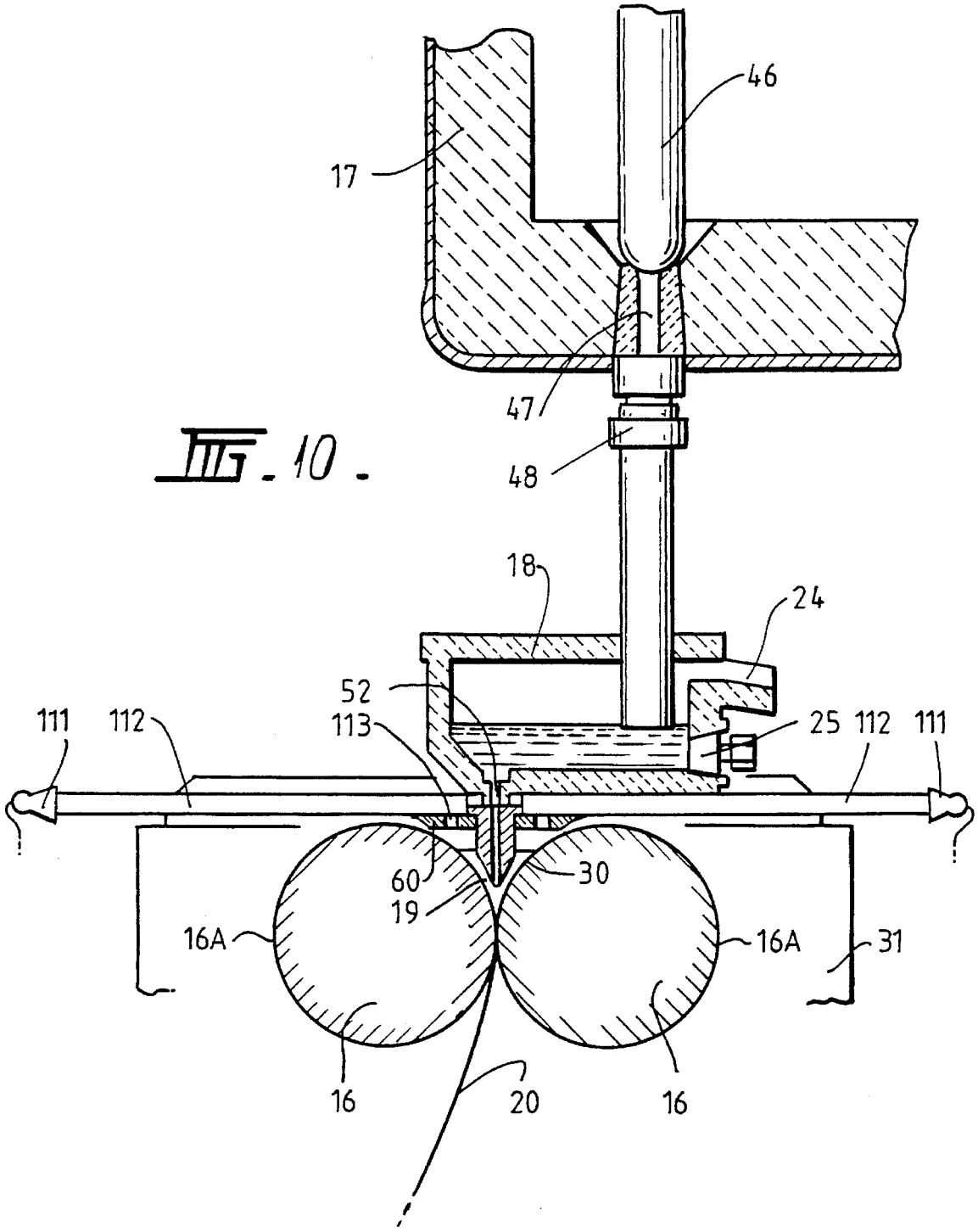
FIG. 10 is a vertical cross-section on the line 10—10 in FIG. 6.

FIG. 5 illustrates the results of experiments to determine the acoustic power requirements for enhanced solidification of carbon steel. This figure plots solidification rates, specified as K-values, for varying amplifier output power values over a number of experiments using smooth cooper substrates and chromium plated substrates with an $R_a$ value of 0.05. It will be seen that increased solidification rates can be achieved with increasing power. However, the available acoustic intensity will generally be limited by the efficiency and capacity of available loud speakers. The sound waves will generally be transmitted at an acoustic intensity in the range of 125 to 150 dB.

As in the case of the application of mechanical vibration to the casting surface as described in our earlier International Application PCT/AU93/00593, it has been found that the refined grain structure and enhanced heat flux cannot be achieved if the casting surface is too rough and it is desirable that the casting surface have an Arithmetical Mean Roughness Value ($R_a$) of less than 5 microns. Best results have been achieved with $R_a$ values of less than 0.2 microns.

FIGS. 6 to 10 illustrate a twin roll continuous strip caster which can be operated in accordance with the present invention. This caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a distributor 18 and delivery nozzle 19 to create a casting pool 30. Casting rolls 16 are water cooled so that shells solidify on the moving roll surfaces 16A and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor or by withdrawal of an emergency plug 25 at one side of the distributor if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16 and to enable the rolls to be rapidly moved apart for a short time interval when it is required to form a transverse line of weakness across the strip as will be explained in more detail below. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce 2000 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor Distributor 18 is also of conventional construction. It is formed as a wide dish made of a refractory material such as magnesium oxide (MgO). One side of the distributor receives molten metal from the ladle and is provided with the aforesaid overflow 24 and emergency plug 25. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as to accurately locate the distributor.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket or plate 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the distributor through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the toiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster, The caster illustrated in FIGS. 6 to 10 can be operated in accordance with the present invention by the incorporation of a pair of sound wave generators 111 and associated acoustic coupling devices 112 through which to transmit sound waves to regions of the casting pool surface to either side of the delivery nozzle 19. The acoustic coupling devices 112 may be in the form a pair of horns attached to or built into the bottom of the metal distributor 18 and coupling with slots 113 in the nozzle mounting plate or bracket 60 through which the sound waves are transmitted to the free surface of the casting pool. Sound generators 111 may be in the form of standard acoustic speakers and the horns 112 may diverge from substantially round or square input ends to wide but narrow outlet ends extending substantially throughout the length of the casting pool one to each side of the delivery nozzle. Speakers 111 may be supplied with appropriate electrical signals at th desired frequency and power via an amplifier (not shown).

Slots 113 in the mounting plate or bracket 60 may be continuous elongate slots extending substantially throughout the length of the casting pool or they may be arranged as two series of slots spaced along the casting pool. In either case, the sound waves will be applied to regions of the casting pool surface disposed to each side of the delivery nozzle and substantially throughout the length of the casting pool between the confining side closure plates 56.

The illustrated apparatus has been advanced by way of example only and the invention is not limited to use of apparatus of this particular kind, or indeed to twin roll casting. It may for example be applied to a single roll caster or to a moving belt caster. It is accordingly to be understood that many modifications and variations will fall in the scope of the appended claims.

We claim:

1. A method of continuously casting metal strip comprising:

forming a casting pool of molten metal in contact with a moving casting surface which casting pool is bounded by said moving casting surface and a free upper surface;

solidifying metal from the pool onto the moving surface;

causing the casting surface to have an Arithmetical Mean Roughness Value ($R_a$) of less than 5 microns; and applying to a free upper surface of the casting pool sound waves in the sonic frequency range thereby inducing relative vibratory movement between the molten metal of the casting pool and the casting surface.

2. A method as claimed in claim 1 comprising transmitting said sound waves from a sound generator through an acoustic coupling channel to the free upper surface of the casting surface.

3. A method as claimed in claim 2, wherein the sound wave generator is an acoustic loudspeaker and the coupling channel is provided by a hollow duct extending from the loudspeaker to a spcae above the free surface of the casting pool.

4. A method as claimed in claim 3, wherein the duct comprises an acoustic horn which increases in cross-sectional area as it extends away from the loudspeaker and which communicates with said space at a location above the free casting pool surface.

5. A method as claimed in claim 1, wherein the Sound waves are in the frequency range 50 to 1000 Hz.

6. A method as claimed in claim 5 comprising applying the sound waves as a wide band noise signal covering the frequencies 200 to 300 Hz.

7. A method of continously casting metal strip comprising:

introducing molten metal into the nip between a pair of parallel casting rolls via a metal delivery nozzle disposed above the nip to create a casting pool of molten metal which is supported on casting surfaces of the rolls immediately above the nip and which has a free upper surface;

counter-rotating the casting rolls to deliver a solidified metal strip downwardly from the nip;

causing the casting surfaces of the rolls to have an Arithmetical Mean Roughness Value ($R_a$) of less than 5 microns; and applying to a free upper surface of the casting pool sound waves in the sonic frequency range thereby inducing relative vibratory movement between the molten metal of the casting pool and the casting surfaces of the rolls.

8. A mehtod as claimed in claim 7 comprising transmitting said sound waves from a sound generator through an acoustic coupling channel to the free upper surface of the casting surface.

9. A mehtod as claimed in claim 8, wherein the sound wave generator is an acoustic loudspeaker and the coupling channel is provided by a hollow duct extending from the loudspeaker to a space above the fee surface of the casting pool.

10. A method as claimed in claim 9, wherein the duct comprises an acoustic horn which increases in cross-sectional area as it extends away form the loudspeaker and which communicates with said space at a location above the free casting pool surface.

11. A method as claimed in claim 7 comprising transmitting said sound waves from a pair of sound wave generators through a respective pair of acoustic coupling ducts which communicate with a space above the free surface of the casting pool at locations to either side of the metal delivery nozzle.

12. A method as claimed in claim 7, wherein the sound waves are in the frequency range 50 to 1000 Hz.

13. A method as claimed in claim 12 comprising applying the sound waves as a wide band noise signal covering the frequencies 200 to 300 Hz.

14. Apparatus for continuously casting metal strip comprising:

a pair of casting rolls forming a nip between them and having casting surfaces which have an Arithmetical Mean Roughness Value ($R_a$) of less than 5 microns;

a metal delivery nozzle for delivery of molten metal into the nip between the casting rolls to form a casting pool of molten metal which is supported on casting surfaces of the rolls immediately above the nip and which has a free upper surface;

roll drive means to drive the casting rolls in counter-rotational directions to produce a solidified strip of metal delivered downwardly from the nip;

a sound generator operable to generate sound waves in the sonic frequency range; and acoustic coupling means defining an acoustic coupling duct acoustically coupling the sound generator to a space above the casting rolls whereby the sound waves are applied to a free upper surface of the casting pool so as to induce relative vibratory movement between the molten metal of the casting pool and the casting surfaces of the rolls.

15. Apparatus as claimed in claim 14, wherein the sound generator is an acoustic loudspeaker and said acoustic coupling duct comprises an acoustic horn which increases in cross-sectional area as it extends away from the loudspeaker toward said space.

16. Apparatus as claimed in claim 15, comprising a pair of acoustic loudspeakers and a respective pair of acoustic coupling ducts extending respectively from a loudspeaker to communicate with said space at respective locations disposed to either side of the metal delivery nozzle.

17. Apparatus as claimed in claim 15, wherein the acoustic loudspeaker is operable to produce sound waves in the frequency range 50 to 1000 Hz.

* * * * *

UNITED STATES PATENT AND TRADEMARK OFFICE

CERTIFICATE OF CORRECTION

PATENT NO. : 5,584,338

DATED : December 17, 1996

INVENTOR(S) : FREEMAN et al.

It is certified that error appears in the above-indentified patent and that said Letters Patent is hereby corrected as shown below:

TITLE PAGE:

Item [73], line 1, delete "Ishikawajima-Hara" insert therefor -- Ishikawajima-Harima --.

Signed and Sealed this

Fifth Day of August, 1997

Bruce Lehman

*Attest:*

BRUCE LEHMAN

*Attesting Officer*

*Commissioner of Patents and Trademarks*